US007953241B2

(12) United States Patent
Jorgensen et al.

(10) Patent No.: US 7,953,241 B2
(45) Date of Patent: May 31, 2011

(54) MICROPHONE ASSEMBLY

(75) Inventors: Martin Bondo Jorgensen, Smorum (DK); Aart Zeger Van Halteren, Hobrede (NL)

(73) Assignee: Sonion Nederland B.V., Amsterdam (NL)

( * ) Notice: Subject to any disclaimer, the term of this patent is extended or adjusted under 35 U.S.C. 154(b) by 1104 days.

(21) Appl. No.: 09/893,997

(22) Filed: Jun. 29, 2001

(65) Prior Publication Data

US 2002/0009206 A1 Jan. 24, 2002

(51) Int. Cl.
*H04R 25/00* (2006.01)

(52) U.S. Cl. ..... 381/356; 381/355; 381/322

(58) Field of Classification Search ..... 381/312, 381/313, 314, 322, 328, 355–361, 91, 92, 381/122, 324

See application file for complete search history.

(56) References Cited

U.S. PATENT DOCUMENTS

| | | | | |
|---|---|---|---|---|
| 3,875,349 | A * | 4/1975 | Ruegg | 381/313 |
| 5,524,056 | A * | 6/1996 | Killion et al. | 381/314 |
| 5,526,430 | A | 6/1996 | Ono et al. | 381/26 |
| 5,757,933 | A | 5/1998 | Preves et al. | 381/68.1 |
| 5,878,147 | A * | 3/1999 | Killion et al. | 381/313 |
| 6,597,793 | B1 * | 7/2003 | Darbut et al. | 381/313 |
| 6,876,749 | B1 * | 4/2005 | Killion et al. | 381/122 |

FOREIGN PATENT DOCUMENTS

| | | |
|---|---|---|
| WO | WO 98/35530 | 8/1998 |
| WO | WO 00/38477 | 6/2000 |
| WO | WO 01/67843 | 9/2001 |
| WO | WO 01/69964 | 9/2001 |

OTHER PUBLICATIONS

Webster's II New Riverside University Dictionary, 1984, p. 634.*

* cited by examiner

*Primary Examiner* — Huyen D Le
(74) *Attorney, Agent, or Firm* — Harness, Dickey & Pierce, P.L.C.

(57) ABSTRACT

A microphone assembly for mounting in an electronic communication device, and wherein the microphone assembly comprises one or more sound inlet port(s) with channels (7), and one or more microphone(s) inside a housing (1). One or more controlling means (5) are an integrated part of the microphone assembly, said controlling means comprising a sound inlet part (6) composing a button and being surrounded by a second casing part (8), the button being loaded by a spring (9). The housing (1) comprises a terminal (2) for grounding the microphone, a terminal (3) connected to e.g. a battery, and a terminal (4) for signalling out.

35 Claims, 4 Drawing Sheets

MICROPHONE ASSEMBLY

CROSS-REFERENCE TO RELATED APPLICATIONS

This application claims priority under 35 U.S.C. §§119 on Provisional Application No. 60/215,068 filed on Jun. 30, 2000.

FIELD OF THE INVENTION

The present invention relates to a microphone assembly for use in electronic communication devices. The microphone assembly has at least one sound inlet port, at least one microphone and at least one controlling means, such as a switch, being an integrated part of the microphone assembly.

BACKGROUND OF THE INVENTION

In nearly all parts of the electronic industry there is a constant striving toward developing smaller electronic communication devices. This development demands a continuous reduction in size for all components commonly utilised in the electronic communication devices.

For example, in the hearing aid industry, the advent of in-the-canal (ITC) type of hearing aids and completely-in-the-canal (CIC) type of hearing aids is only rendered possible because of constantly reductions in the size of the hearing aids. Many users or potential users find it cosmetically attractive to wear an aid that may be completely contained within the ear canal, since this renders the aid invisible, at least in a majority of everyday situations.

Furthermore, hearing aids of the ITC and CIC types provide acoustical benefits compared to a behind-the-ear (BTE) type of instrument. One benefit is improved directional hearing due to a major part of the outer ear being left unblocked by the ITC and CIC hearing aids, thereby preserving the natural directional properties of the outer ear.

A further example is the mobile phones, where the size of the mobile phones has been drastically reduced in recent years, even though they provide an increasing number of features.

Hearing aids as well as mobile phones and headsets are usually provided with one or several controlling means, such as push buttons, switches, etc., which may be located on a face part of the housing. The controlling means may be adapted to provide a number of functions, such as turning the electronic communication device or a part thereof, such as the microphone assembly, on/off, controlling a gain, changing between a number of predetermined programs, and, in the example of hearing aids, changing between a microphone signal and a telecoil signal, etc.

Further, many electronic communication devices are provided with connection means so as to facilitate data communication between an external programming system and a processor or memory device within the electronic communication device.

In a hearing aid for example, the size of utilised components, including the microphone, are constantly reduced so that the available area of faceplate is constantly reduced. Thereby, faceplate area occupied by the controlling and connection means of the hearing aid is an increasing problem for the further miniaturisation of ITC and CIC types of hearing aids.

As the user of the hearing aid must be able to operate the controlling means of the hearing aid this limits the possible reduction in physical dimensions of the hearing aid controlling means.

A number of different functions of the electronic communication devices may be implemented by the present microphone assembly, such as turning a battery supply on/off, adjusting a volume control or trimmer, selecting different states and/or pre-set programs of the electronic communication device, such as selecting between a microphone and a telecoil input signal in a hearing aid, etc., may be provided the present electronic communication device.

SUMMARY OF THE INVENTION

It is an object of the present invention to provide an electronic communication device with a microphone assembly that minimises the faceplate area required by the controlling and connection means to solve the above-mentioned disadvantages.

According to a first aspect of the invention, the above-mentioned and other objects are fulfilled by a microphone assembly for mounting in an electronic communication device, the microphone assembly comprising one or more sound inlet port(s), one or more microphone(s) and one or more controlling means, said controlling means being an integrated part of the microphone assembly. The controlling means may be positioned next to the sound inlet port on the same surface part as the sound inlet port or, alternatively, the sound inlet port and the controlling means may be positioned at different surface parts of the microphone assembly.

The combination of the microphone assembly and the sound inlet port with the controlling means, the assembly of e.g. a hearing aid is eased as only one element comprising the controlling means and the sound inlet port has to be fitted into the hearing aid faceplate.

In a preferred embodiment of the present invention the controlling means forms part of the one or more sound inlet port(s). Hereby, the space requirements are heavily reduced as only one element is to be positioned on a surface part of the microphone assembly.

The one or more microphone(s) may comprise a directional microphone having at least two sound inlet spouts each being connected to a sound inlet port, and/or comprise an omni-directional microphone having at least one sound inlet spout connected to a sound inlet port.

In an embodiment, one of the at least two inlet spouts of the directional microphone may merge with the at least one inlet spout of the omni-directional microphone into a combined spout. Thus, the total number of spouts may be reduced from three spouts to two spouts.

By combining a directional and an omni-directional microphone in one assembly, the user has the possibility to change between at least two modes; one directional mode if the user only wants to hear sound from one preferred direction (e.g. telephone conversation), and one omni-directional mode if the user wants to hear sound from a plurality of directions (e.g. in the traffic).

Each sound inlet port and/or each microphone may comprise controlling means for controlling the operation of the whole electronic communication device and/or the operation of the microphone.

The sound inlet spouts of the one or more directional microphones and/or omni-directional microphones may be combined with one or more spouts of external microphones outside the assembly.

Thus, two, three or more microphones may be mounted in one assembly, so that is possible to have a plurality of combined microphones in e.g. a housing of a hearing aid. Combining the microphones may reduce the number of sound inlets and controlling means. However, the number of controlling means may depend on how many operations there have to be controlled.

For example can two microphones with the same frequency response be combined and used in directional applications. The controlling means may also be combined.

The controlling means may be positioned so as to facilitate operation of the at least one controlling means by applying a predetermined force to an integrated part of the microphone assembly. The predetermined force may be any force, such as force applied by the user of the electronic communication device, such as shear stress or normal stress, such as torque, etc.

The at least one controlling means may comprise one or more switches, such as a push button, a turning knob, such as a switch responsive to a force applied to tragus, etc. The switch may be adapted to e.g. electrically connect and disconnect two externally accessible switch terminals or switch between an on-state and an off-state of the microphone assembly.

For example in a headset, the possibility of turning the microphone assembly off at the microphone itself may be very convenient to the headset user.

Furthermore, at least one of the controlling means may be a volume control, so as to regulate e.g. the volume of the sound reaching the user of a hearing aid or so as to regulate the volume of an incoming call in a mobile telephone.

Still further, the controlling means may be adapted to provide at least one control signal adapted to control operations of the electronic communication device. The control signal may further be adapted to control operations of the microphone assembly and other components of the assembly, such as the one or more microphone(s).

The control signal may, for example, be adapted to power the electronic communication device down and/or to activate the electronic communication device.

The controlling means and control signal may be adapted to control the calibration of the one or more microphone(s).

In a preferred embodiment, the switch is a push button comprising at least a first and a second part positioned so that at least a part of the first part is surrounded by at least a part of the second part and the first part further being adapted to be moved relative to the second part. By activating the push button all or at least some of the above-mentioned functionalities may be achieved.

The electronic communication device may comprise a number of predetermined programs and the one or more controlling means may then be adapted to provide a control signal to switch the electronic communication device between the number of predetermined programs. The predetermined programs may be stored in any memory, such as an electronic memory, such as an EEPROM, etc. The memory may be positioned in the microphone assembly or more preferably in the electronic communication device.

In a hearing aid, for example, the predetermined programs may be any listening programs so as to allow the user to select a listening program specifically designed to the current acoustical environment, i.e. to select one program for use in the traffic and another program for telephone conversations etc.

Another example is in a mobile phone, where the predetermined programs may comprise any programming of the mobile phone, such as for example adapting a dial tone according to the situation: discrete when in meetings, louder in the traffic, etc.

In order to minimise noise in the controlling means, the controlling means may be adapted to control the switch, the volume control, etc, so that the controlled operation, i. e. the switching, the volume level, etc., is performed smoothly. For example, if the switch, the volume control, etc., induce a change in capacity between two parts, the change may be read by a circuit adapted to read the change(s) in capacitance between the two parts, so that the control operation become smooth without inducing unnecessary noise in the controlling means.

The assembly may further comprise a connector comprising one or more connection means, the connector and the one or more connection means may form an integrated part of the microphone assembly. Preferably, the connection means protrudes from a surface part of the assembly.

Having the connector forming part of the microphone assembly saves space as only the connection means may protrude from a surface part of the microphone. Hereby, the addition of for example an add-on adapter comprising the connector is unnecessary, which makes it possible to manufacture the present microphone assembly with a width 1-2 mm less than the width of a conventional microphone and an add-on adapter. Accordingly, the present microphone assembly makes it possible to save a substantially area of the face part of the hearing aid.

The electronic communication device may comprise one or more processing means having a programming port, and wherein a number of connection means in a first end is connected to the programming port of the processing means and in a second end is adapted to form operative connection to an external programming system so that at least one communication channel is formed between the programming port and the external programming system.

The processing means may not only program the whole electronic communication device, but also the microphone(s) or other components of the device. Preferably, the processing means forms an integrated part of the microphone assembly and/or the one or more microphone(s). Alternatively or additionally, the processing means may be located outside the assembly.

The processing means and the controlling means may not only be adapted to program, but also to calibrate the one or more microphones. Thus, as the assembly may comprise two or more microphones, it may also comprise two or more processing means.

The microphone assembly may comprise processing means for each of the microphones or for just some of them. The processing means may comprise any processor, such as a general purpose or a proprietary Digital Signal Processor (DSP), and the communication channel may be provided by means of a cable, by means of infra red radiation (IR), by radio frequencies (RF), or by any other communication means.

One communication channel may comprise a channel for transmission of data signals between the processing means and the external programming system. Furthermore, communication channels may be provided for the transmission of a clock signal, a battery voltage, or to provide for grounding of the electronic communication device. Still further, the data signals may be communicated asynchronously or synchronously between the external programming system and the processor.

The external programming system may for example be a programming system adapted to communicate and program a hearing aid processor to adjust the hearing aid to optimally compensate a hearing loss of the patient involved.

The one or more connection means may be adapted to provide contact to a power source, such as a battery, for the microphone assembly. The assembly may comprise more than one battery.

For example in a hearing aid, the battery terminals have hitherto been cast in the faceplate. This is a complicated process where the battery terminals must be provided in the mould adding costs and complexity to the manufacturing process. By adapting the battery connector to provide these battery terminals forming part of the microphone assembly therefore reduces the overall costs and complexity of the hearing aid manufacturing.

Furthermore, the microphone assembly may contain one or more moisture and/or contamination filter(s) forming part of the controlling means. Typically, a moisture filter is provided as a narrow-mesh net positioned just above the sound inlet. By combining the moisture filter with the controlling means the difficult positioning of the tiny net is avoided so that the time and cost in assembling the microphone assembly is reduced.

Still further, the microphone assembly may comprise one or more damping grid(s) for controlling the frequency response of the microphone(s). The damping grid may form part of the controlling means and may, for example, form part of the moisture filter. Depending upon the size of the grid and particularly upon the size of the openings in the grid, the frequency response of the microphone(s) may be controlled. Having, for example, smaller holes in the grid will result in a more significant damping of the peak signal of the microphone(s).

According to a second aspect of the invention the microphone assembly may comprise a connector comprising one or more connection means, and wherein the connector and the connection means form an integrated part of the microphone assembly. The one or more connection means may protrude from a surface part of the microphone assembly or be located inside the one or more microphone(s).

The one or more connection means may be adapted to provide contact to a power source, such as a battery, for the microphone assembly.

The electronic communication device may comprise one or more processing means having a programming port, and wherein a number of connection means in a first end is connected to the programming port of the processing means and in a second end is adapted to form operative connection to an external programming system so that at least one communication channel is formed between the programming port and the external programming system.

The microphone assembly according to the second aspect may comprise any features and elements mentioned in connection with the microphone assembly according to the first aspect.

The microphone assembly according to the first and/or second aspect may be mounted in any communication device, such as mobile phones/terminals, headsets, assisting listening devices, or hearing aids. The assembly may be used to other devices than electronic communication devices, such as audio recording devices.

According to a third aspect of the invention, a method for controlling an electronic communication device comprising a microphone assembly according to the first aspect, wherein one or more of the controlling means is positioned in a frame of the electronic communication device so as to facilitate operation of the controlling means by a user of the electronic communication device, the method comprising the steps of:

applying a predetermined force to an integrated part of the microphone assembly, detecting a control signal in response to the applied force, and operating the processing means of the electronic communication device according to the detected control signal, whereby the electronic communication device is operated according to the operation of the controlling means.

BRIEF DESCRIPTION OF THE DRAWINGS

In the following, a preferred embodiment of a microphone assembly will be described with reference to the drawings, wherein.

DETAILED DESCRIPTION OF THE DRAWINGS

Figure 1:
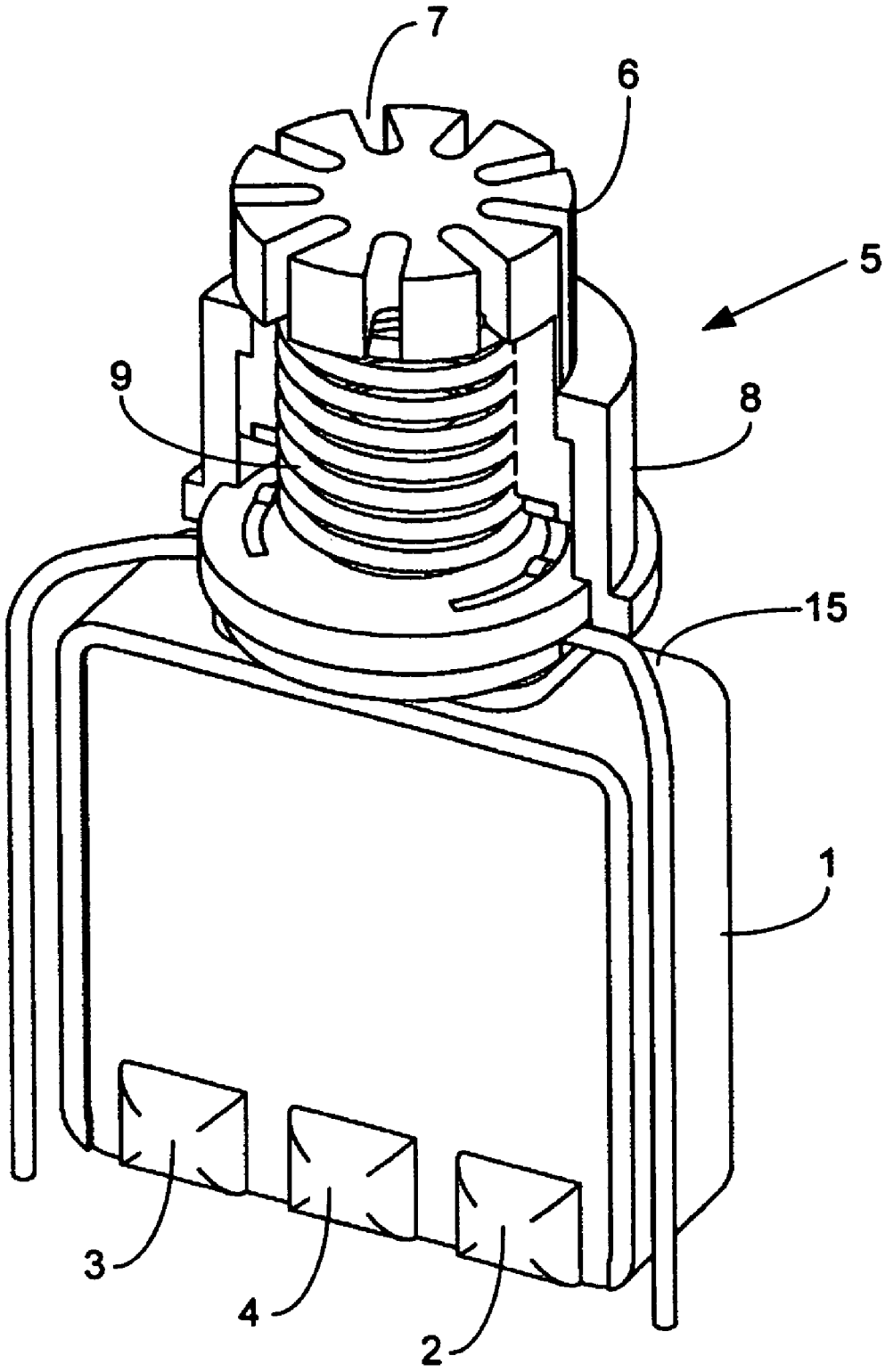
FIG. 1 shows a microphone assembly according to a preferred embodiment of the present invention.

With reference to FIG. 1, a microphone assembly according to a preferred embodiment of the present invention is shown. In this preferred embodiment the controlling means is a push button.

In the microphone housing 1 three terminals are provided: a terminal 2 for grounding the microphone, a terminal 3 connected to e.g. the battery voltage or a regulated supply, and a terminal 4 for signal out (i.e. sound out).

The sound inlet port 5 is positioned on top of the microphone on a surface part 15 of the microphone, and comprises a first sound inlet part 6 having a form so as to allow the sound to proceed to a sound inlet aperture (see FIG. 3) in the microphone housing 1. The sound inlet part may for example be provided with a number of channels 7 allowing the sound to proceed to the sound inlet aperture. The sound inlet port 5 further comprises a second casing part 8 surrounding at least part of the first sound inlet part 6. The first sound inlet part 6 may be movable relative to the second casing part 8, and the second casing part may further surround a spring 9. The spring may be fabricated of a metal, such as copper, such as steel, etc, or of a suitable plastic material.

Figure 2:
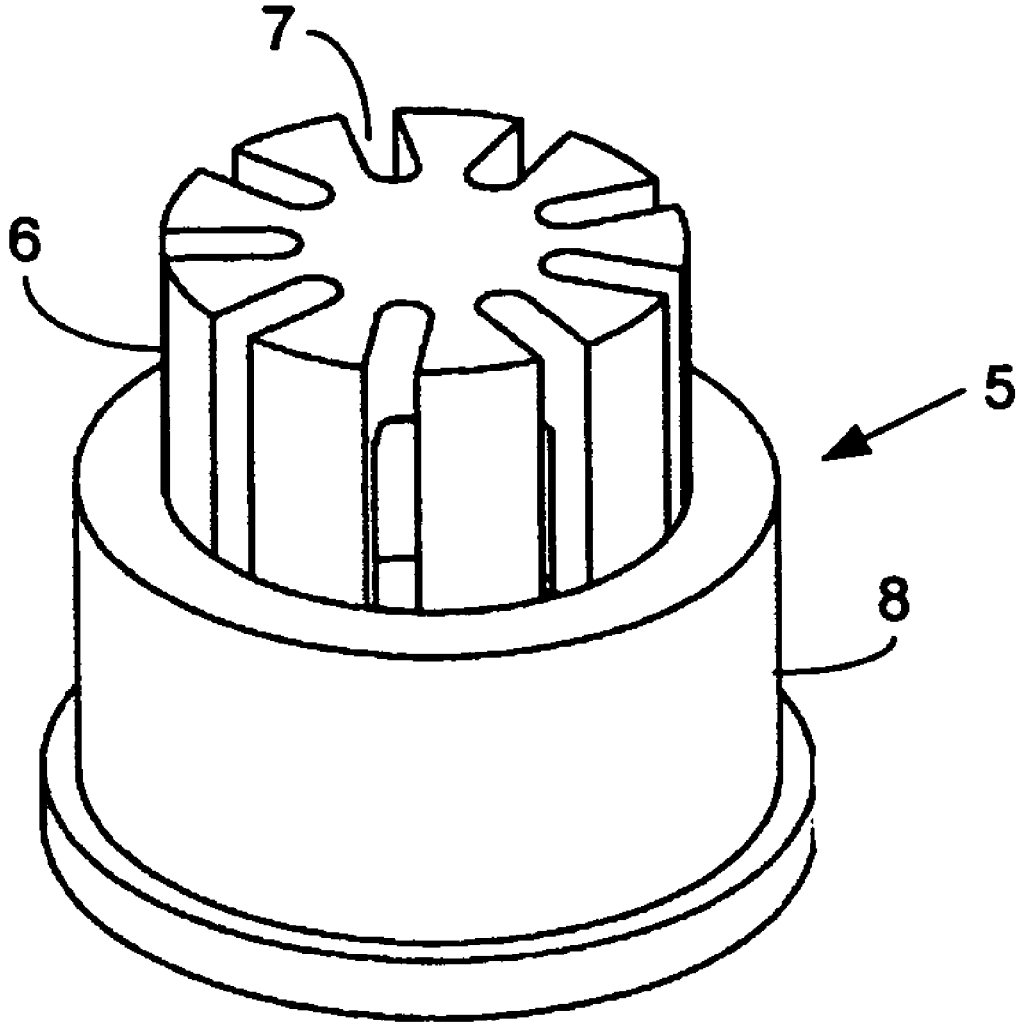
FIG. 2 shows the sound inlet port and the switch.

FIG. 2 shows the controlling means corresponding to the sound inlet port 5 comprising the first sound inlet part 6 having sound channels 7 and the second casing part 8. By controlling the size and/or amount of the channels 7, the damping of the microphone signal may be controlled. Hereby, no external damping grid need to be applied, resulting in a cost effective and less complex design of the microphone.

Furthermore, if, for example, the first sound inlet part 6 is performed in a conductive material, preferably a material having a low conductivity, then movement of the first sound inlet part 6 in relation to the microphone housing 1 and/or a switch contact would induce a change in capacitance. Hereby, a smooth operation of the controlling means is obtained. The change in capacitance may be read by a reasonable simple IC, not shown.

Figure 3:
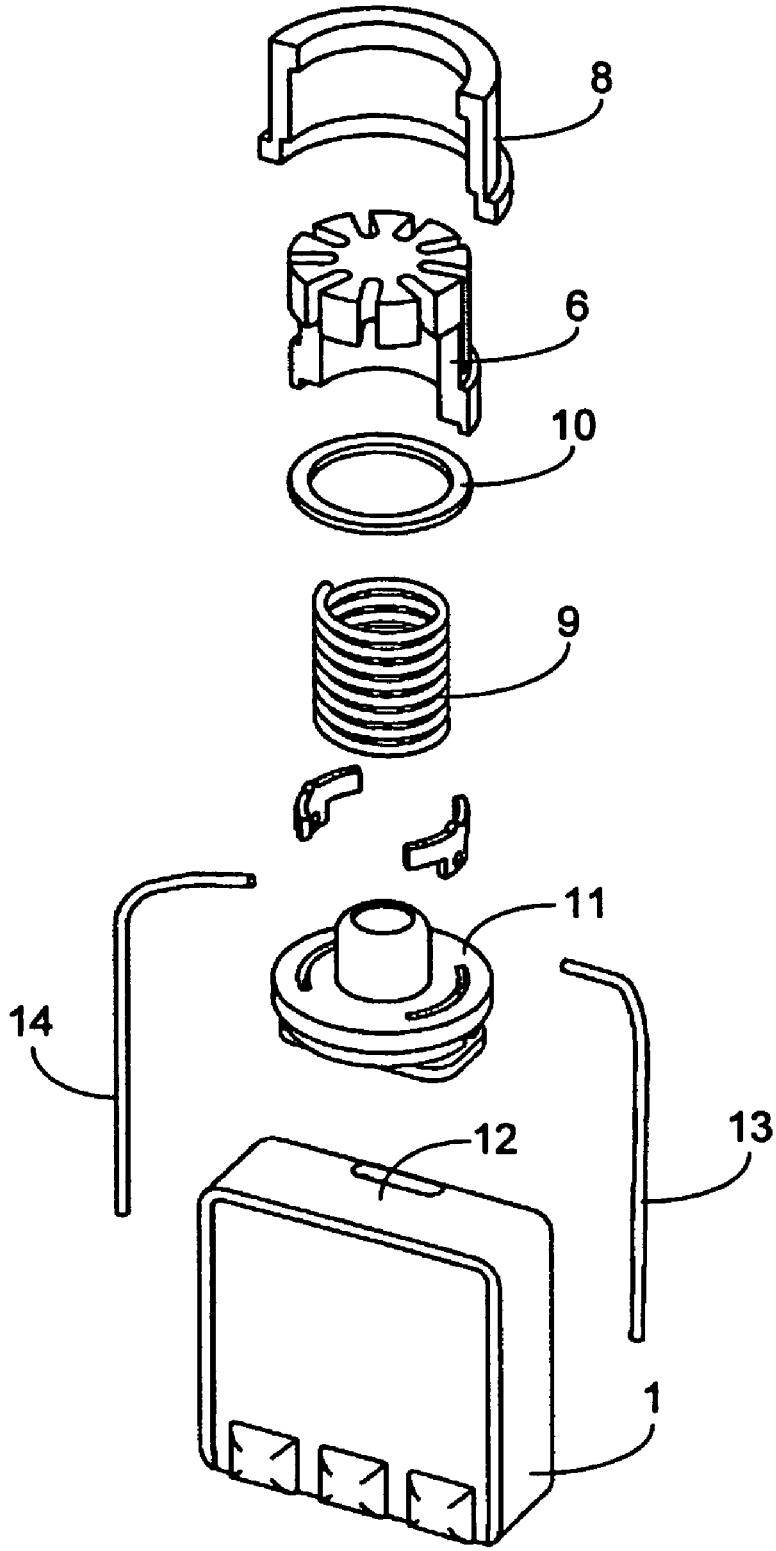
FIG. 3 is an exploded view of the microphone assembly.

In FIG. 3, an exploded view of the microphone assembly is shown. The microphone assembly comprises a second casing part 8, a first sound inlet part 6, a contact plate 10, a spring 9, and a sound inlet spout 11 positioned above a sound inlet aperture 12 in the microphone housing 1. Two wires 13, 14 are in a first end connected to the sound inlet spout, and when the parts constituting the microphone assembly are assembled, the depression of the first sound inlet part connects/disconnects the wires 13 and 14.

The connection/disconnection of the wires 13 and 14 may provide a simple connection/disconnection of the hearing aid battery (not shown), so that the hearing aid is turned on/off accordingly.

In a further example, the connection/disconnection of the wires 13 and 14 may trigger a control signal to be sent. A second end of the wire 13 may for example be grounded whereas a second end of the wire 14 may be connected to a processor, such as a DSP. The processor may then read the control signal provided by the wire 14. The control signal may for example be logic "0" or low as long as the push button is not depressed, i.e. the wires 13 and 14 are not connected. When the push button is depressed, the wires 13 and 14 are connected providing a pulse in the control signal as the control signal is changed to logic "1" or high. Now, the processor may respond either to a rising edge of the pulse, or to a falling edge of the pulse. Alternatively, the processor may be adapted to respond to the logic level of the control signal.

The processor may then be adapted to, for example, change between prestored programs when the rising edge of a pulse is sensed, or the gain of the hearing aid may be lowered in proportion to the sensed duration of a particular logic state of the control signal.

Figure 4:
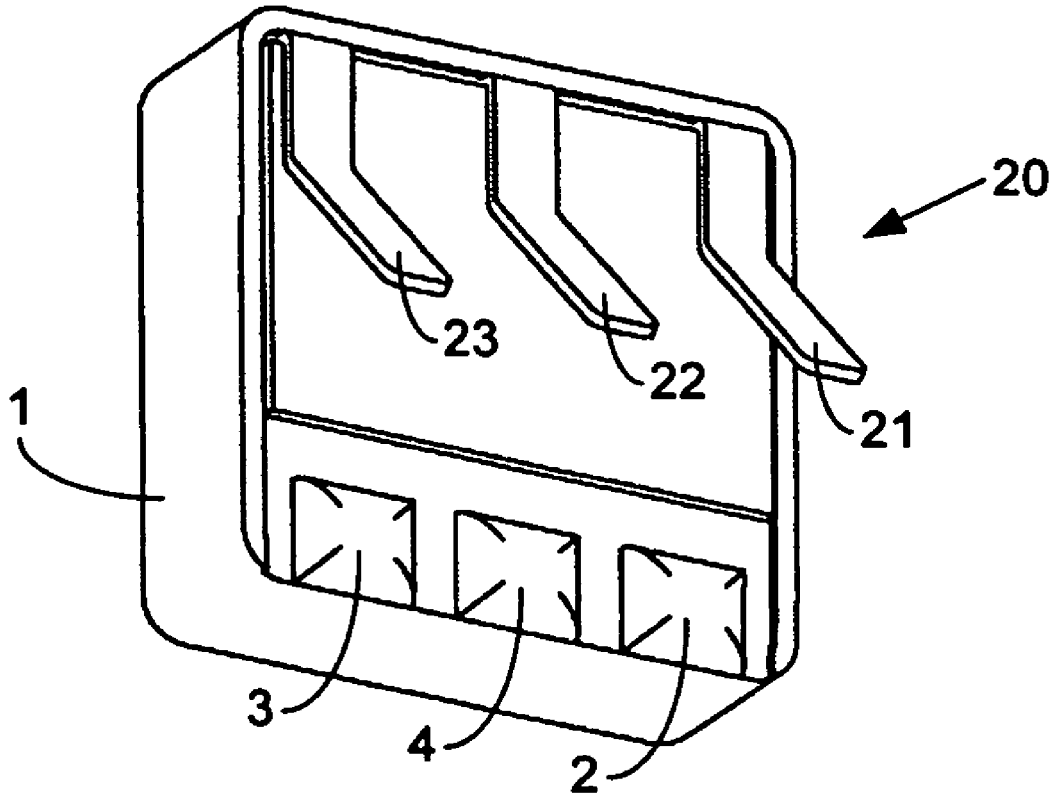
FIG. 4 shows a microphone assembly and a connector having three connection means.

FIG. 4 shows a microphone assembly according to the second aspect of the invention. In the microphone housing 1, three terminals 2, 3 and 4 are provided as in FIG. 1.

Furthermore, a connector 20 having three connection means 21, 22 and 23 are provided. These terminals 21, 22 and 23 are in a first end connected to a programming port (not shown) of a processor and are in a second end adapted to form operative connection to an external programming system (not shown) so that a communication channels with signals DATA, CLOCK and GND are formed between the programming port and the external programming system.

The communication channels may be provided by means of a cable, by means of infra red radiation (IR), by radio frequencies (RF), or by any other communication means.

Alternatively, four connection means may be provided in the present microphone assembly so that a conductor for the providing the battery voltage is included. In another alternative the clock signal may be omitted and asynchronous data transmission between the processor and the programming system provided.

In this preferred embodiment the external programming system is a programming system adapted to adjust each individual hearing aid according to the hearing loss of the patient involved.

Alternatively or concurrently, two connection means, such as flat springs, may be adapted to provide contact to a power source, such as a battery, for the hearing aid.

The invention claimed is:

1. A microphone assembly including a casing mounted in an electronic communication device, the microphone assembly comprising:

one or more sound inlet ports, one or more microphones within the casing, one or more channels for allowing sound to pass through the one or more sound inlet ports to the one or more microphones, and one or more electrical controlling devices within the casing that can be operated by a user for selectively controlling the operation of the assembly, wherein the one or more sound inlet ports, the one or more microphones and the one or more electrical controlling devices are combined to form an integrated microphone assembly, and wherein the one or more electrical controlling devices form part of the one or more sound inlet ports and can be operated by the user without affecting a configuration of any of the one or more sound inlet ports, any of the one or more channels and any path the sound will follow from the one or more sound inlet ports to the one or more microphones.

2. A microphone assembly according to claim 1, wherein the one or more microphones comprises a directional microphone having a sound inlet spout connected to a sound inlet port.

3. A microphone assembly according to claim 1, wherein the one or more microphones comprises an omni-directional microphone having at least one sound inlet spout connected to a sound inlet port.

4. A microphone assembly according to claim 1, wherein each sound inlet port or each microphone comprises electrical controlling devices.

5. A microphone assembly according to claim 1, wherein the electrical controlling devices is positioned so as to facilitate operation by applying a force to the integrated microphone assembly.

6. A microphone assembly according to claim 5, wherein the operations of the electronic communication device comprises powering the electronic communication device down and/or activating the electronic communication device.

7. A microphone assembly according to claim 1, wherein the electrical controlling device comprises a switch.

8. A microphone assembly according to claim 7, wherein at least one of the electrical controlling device is adapted to switch between an on-state and an off-state of the microphone assembly.

9. A microphone assembly according to claim 1, wherein the controlling means is adapted to provide at least one control signal.

10. A microphone assembly according to claim 9, wherein the at least one control signal is adapted to control operations of the electronic communication device.

11. A microphone assembly according to claim 9, wherein the at least one control signal is further adapted to control operations of the microphone assembly.

12. A microphone assembly according to claim 9, wherein the electronic communication device comprises a number of predetermined programs and wherein the one or more controlling means is adapted to provide a control signal to switch the electronic communication device between the number of predetermined programs.

13. A microphone assembly according to claim 1, wherein the electrical controlling device is adapted to control calibration of the one or more microphones.

14. A microphone assembly according to claim 1, wherein the microphone assembly further comprises a connector comprising one or more connection means, the connector and the connection means form an integrated part of the microphone assembly.

15. A microphone assembly according to claim 14, wherein the electronic communication device comprises one or more processing means having a programming port, and wherein a number of connection means, in a first end, is connected to the programming port of the processing means and, in a second end, is adapted to form operative connection to an external programming system so that at least one communication channel is formed between the programming port and the external programming system.

16. A microphone assembly according to claim 15, wherein the processing means is adapted to program the electronic communication device and/or the one or more microphone(s).

17. A microphone assembly according to claim 15, wherein the processing means forms an integrated part of the microphone assembly or the one or more microphone(s).

18. A microphone assembly according to claim 15, and comprising processing means for each of the microphone.

19. A microphone assembly according to claim 15, wherein the processing means comprises a Digital Signal Processor.

20. A microphone assembly according to claim 15, wherein the at least one communication channel is provided by means of a cable, by means of infra red radiation (IR), or by radio frequencies (RF).

21. A microphone assembly according to claim 15, wherein the at least one communication channel comprises a channel for transmission of data signals between the processing means and the external programming system.

22. A method for controlling an electronic communication device comprising a microphone assembly according to claim 15, wherein one or more of the controlling means is positioned in a frame of the electronic communication device so as to facilitate operation of the controlling means by a user of the electronic communication device, the method comprising the steps of: applying a predetermined force to an integrated part of the microphone assembly, detecting a control signal in response to the applied force, and operating the processing means of the electronic communication device according to the detected control signal, whereby the electronic communication device is operated according to the operation of the controlling means.

23. A microphone assembly according to claim 14, wherein at least one connection means is adapted to provide contact to a power source for the microphone assembly.

24. A microphone assembly according to claim 23, wherein the power source is a battery.

25. A hearing aid, a mobile phone and/or a headset comprising a microphone assembly according to claim 1.

26. The microphone assembly according to claim 1, wherein the electrical controlling device includes a user operable actuator having a generally rounded outer configuration.

27. A microphone assembly for mounting in an electronic communication device, the microphone assembly comprising:

a microphone housing;

a sound inlet port for passing sound to the microphone housing;

a channel for allowing sound to pass through the sound inlet port to a microphone, and wherein an electrical controlling device forming at least part of the sound inlet port, the electrical controlling device being operable by a user for selectively controlling operation of the microphone assembly and without affecting any path the sound will follow from the sound inlet port to the microphone housing.

28. The microphone assembly set forth in claim 27, wherein the electrical controlling device is disposed at least partly within the sound inlet port.

29. The microphone assembly set forth in claim 27, wherein the electrical controlling device includes a first part and a second part, the first part of the electrical controlling device being movable relative to both the second part of the electrical controlling device and the microphone housing.

30. The microphone assembly set forth in claim 29, wherein the first part of the electrical controlling device includes channels for allowing sound to pass through the sound inlet port to the microphone housing.

31. The microphone assembly set forth in claim 30, wherein the first part of the electrical controlling device includes a push button.

32. The microphone assembly set forth in claim 27, wherein the electrical controlling device includes channels that extend at least partly into the sound inlet port for allowing sound to pass through the sound inlet port to the microphone housing.

33. The microphone assembly set forth in claim 27, wherein the microphone housing includes an outer surface and an inlet formed in the outer surface, the sound inlet port being disposed adjacent the outer surface of the microphone housing generally over the inlet for passing sound to the microphone housing.

34. The microphone assembly set forth in claim 27, wherein the electrical controlling device includes an actuator having a generally rounded outer configuration.

35. A microphone assembly for mounting in an electronic communication device, the microphone assembly having a sound inlet port, and an electrical controlling device that can be operated by a user for selectively controlling the operation of the assembly and without affecting any path a sound will follow from the sound inlet port to the assembly, said sound inlet port and said electrical controlling device being combined to form an integrated microphone assembly, wherein the electrical controlling device forms part of the sound inlet port, and wherein the electrical controlling device includes a user operable actuator having a generally rounded outer configuration.

* * * * *